US006760455B2

(12) United States Patent
Croft, III et al.

(10) Patent No.: US 6,760,455 B2
(45) Date of Patent: Jul. 6, 2004

(54) ELECTROSTATIC LOUDSPEAKER WITH A DISTRIBUTED FILTER

(75) Inventors: James J. Croft, III, Poway, CA (US); Robert C. Williamson, La Jolla, CA (US)

(73) Assignee: American Technology Corporation, San Diego, CA (US)

( * ) Notice: Subject to any disclaimer, the term of this patent is extended or adjusted under 35 U.S.C. 154(b) by 129 days.

(21) Appl. No.: 09/905,634

(22) Filed: Jul. 13, 2001

(65) Prior Publication Data

US 2002/0080984 A1 Jun. 27, 2002

Related U.S. Application Data

(60) Provisional application No. 60/217,966, filed on Jul. 13, 2000.

(51) Int. Cl.[7] ..... H04R 25/00

(52) U.S. Cl. ..... 381/191; 381/190; 381/173

(58) Field of Search ..... 381/113, 116, 381/174, 190–191, 176, 399, 423, 426–427, 173, 431; 181/167–168; 367/170, 181

(56) References Cited

U.S. PATENT DOCUMENTS

| | | | | | |
|---|---|---|---|---|---|
| 2,177,629 | A | * | 10/1939 | Foster | 381/190 |
| 2,231,159 | A | * | 2/1941 | Gerlach | 523/300 |
| 2,472,179 | A | * | 6/1949 | Tibhetts | 310/363 |
| 2,614,144 | A | * | 10/1952 | Howatt | 310/330 |
| 2,631,196 | A | | 3/1953 | Janszen | |
| 3,014,098 | A | | 12/1961 | Malme | |
| 3,792,204 | A | * | 2/1974 | Murayama et al. | 310/340 |
| 3,894,198 | A | * | 7/1975 | Murayama et al. | 381/114 |
| 4,703,509 | A | | 10/1987 | Kanchev | |
| 4,799,265 | A | | 1/1989 | Streng | |
| 6,427,017 | B1 | * | 7/2002 | Toki | 381/190 |

FOREIGN PATENT DOCUMENTS

| | | |
|---|---|---|
| GB | 537931 | 7/1941 |

* cited by examiner

*Primary Examiner*—Curtis Kuntz
*Assistant Examiner*—P. Dabney
(74) *Attorney, Agent, or Firm*—Thorpe North & Western LLP

(57) ABSTRACT

An electrostatic loudspeaker includes a high resistivity stator with electrode conductivity per square that is constant and/or decreases with distance from the connection point. A contact area of predetermined size is related to the highest frequency of interest. The constant or decreasing surface resistivity of the stators, interacting with the capacitive load of the stator to stator gap, operates as a distributed network such that the active acoustic output is attenuated in a predetermined manner with increased frequency at all points equidistant on the stator from the connection area. The apparent acoustic source size is reduced as the frequency increases to maintain enhanced dispersion across the operating range of the loudspeaker system.

16 Claims, 5 Drawing Sheets

ELECTROSTATIC LOUDSPEAKER WITH A DISTRIBUTED FILTER

This application claims priority from U.S. Provisional Patent Application No. 60/217,966 filed on Jul. 13, 2000.

TECHNICAL FIELD

This invention relates generally to the field of electrostatic loudspeakers.

BACKGROUND ART

Historically, electrostatic loudspeakers have been acknowledged for their excellent sound quality and lack of audible coloration associated with more conventional cone/enclosure type loudspeakers. Even so, the electrostatic loudspeaker, which has been under development since the 19th century, has never successfully represented more than a very small percentage of loudspeakers sold. There have been many attempts to solve some of the electrostatic loudspeaker limitations such as: capacitive reactance, overly high directivity, frequency response aberrations, voltage breakdown limits, and transformer design/interaction.

Most electrostatic loudspeakers fall into one of a few configurations. The most basic configuration is a large, full range device without crossovers which suffers from a lack of sound dispersion, particularly in the higher frequency ranges. A second type of system consists of separate electrostatic elements, each covering a different frequency range. A multiple element system utilizes a crossover network between a large diaphragm area transducer for low frequencies that progressively crosses over to smaller diaphragm areas for the higher frequencies. This system has greater cost and complexity and does not allow the use of the total combined diaphragm area available for low frequencies because the diaphragm is divided into separately sized areas.

Another group of electrostatic devices attempts to solve the directivity problem by using a plurality of separate stator sections with a multitude of resistors. In these devices, each resistor is connected to a different stator section in an attempt to manipulate the drive signal to different parts of the diaphragm in a frequency selective manner. One attempt is shown in British Patent No. 537,931 to Shorter, entitled "Improvements in Electrostatic Loudspeakers." Shorter teaches the use of a plurality of external stator resistors arranged to drive each section of the stator. Different resistance values are combined with different bias resistor values causing varying bias levels in each section. This approach requires a construction with many connection points being created across the diaphragm and a plurality of individual stator sections gapped and insulated from each other. Using multiple sections only produces an approximate, step-wise result unless a very high number of sections are implemented which makes the complexity reach levels of impracticality far short of the number that would provide seamless transitions. Another version of this approach is shown in U.S. Pat. No. 2,631,196 to Janszen, entitled Electrostatic Loud Speaker. This configuration is also complex and more expensive to manufacture.

Another drawback with electrostatic loudspeakers using external resistors is that they suffer from increased capacitance and/or a loss of drive in the gaps between sections. Because the edges of each section must be fixed there is a loss of energy at those points as compared to a larger continuous diaphragm, and multiple diaphragm systems are more difficult to manufacture.

SUMMARY

It has been recognized that it would be an improvement over the state of the art to provide a new method and apparatus for an electrostatic speaker that allows electronic audio signals to be applied to the stators in a more controlled and patterned way. More specifically, it would be valuable to be able to control the radiation patterns of the speaker by applying electronic audio signals to the stators in a controlled configuration.

One embodiment of the invention is an electrostatic loudspeaker which includes a high resistivity stator with electrode conductivity per square unit that decreases with distance from the connection point. An electrical contact area of predetermined size has a resistivity that relates to the highest frequency of interest. Outside the electrical contact area, an immediately adjacent area of high starting value, and then outwardly decreasing surface resistivity of the stators interacts with the capacitive load of the stator/diaphragm structure. The decreasing surface resistivity operates as a distributed network where the active acoustic output is attenuated in a predetermined manner with increased frequency at all points distant from the contact area. The apparent acoustic source size is reduced with increased frequency to maintain enhanced dispersion across the operating range of the loudspeaker system.

In another embodiment, an electrostatic loudspeaker with a high resistance stator electrode (greater than 10K Ohms/square), includes a low impedance (less than 1K Ohms/square) connection area such that the output is attenuated with increased frequency at all points distant from the connection area.

A variety of improvements are derived from these embodiments, such as, reduced breakdown voltage concentrations, directivity control, reduction of capacitive reactance, reduction of the effects of transformer leakage inductance, flatter frequency response, visual transparency and simplicity of construction.

These and other objects, features, advantages and alternative aspects of the present invention will become apparent to those skilled in the art from a consideration of the following detailed description taken in combination with the accompanying drawings.

DISCLOSURE OF THE INVENTION

Reference will now be made to the drawings in which the various elements of the present invention will be given numerical designations and in which the invention will be discussed so as to enable one skilled in the art to make and use the invention. It is to be understood that the following description is only exemplary of certain embodiments of the present invention, and should not be viewed as narrowing the claims which follow.

An electrostatic loudspeaker device comprises at least one partially conductive diaphragm 101 and at least two stationary electrodes 102, 103 parallel to the diaphragm, spaced a selected gap from the one conductive diaphragm. The conductive diaphragm can be made of a thin metalized plastic film which is made from polyester (Mylar™), polyvinylidene di-fluoride (PVDF), PVDC and plastics with similar properties. An electronic signal is applied to the two stationary electrodes or stators to drive the diaphragm. The stators conventionally are made from conductive material or have a conductive coating or metal coating to receive a signal across the stator. When the diaphragm is driven, it produces sound waves or ultrasonic sound waves. It is often difficult to control the directionality of the sound waves produced by these electrostatic transducers.

In general, the invention utilizes the fact that an electrostatic loudspeaker has an inherent 6 dB per octave rising characteristic in the on-axis amplitude response with increasing frequency, high directivity, limited dispersion and further, it is predominately a capacitive load. See FIG. 5. The 6 dB per octave increase in axial response can be converted to a flatter axial amplitude response while converting the excess axial energy to wider dispersion and therefore improved power response. This can be done in just one plane, such as increasing horizontal dispersion only as in FIGS. 4 and 5, or the same can be accomplished in both horizontal and vertical planes see FIGS. 1 and 2.

Figure 1:
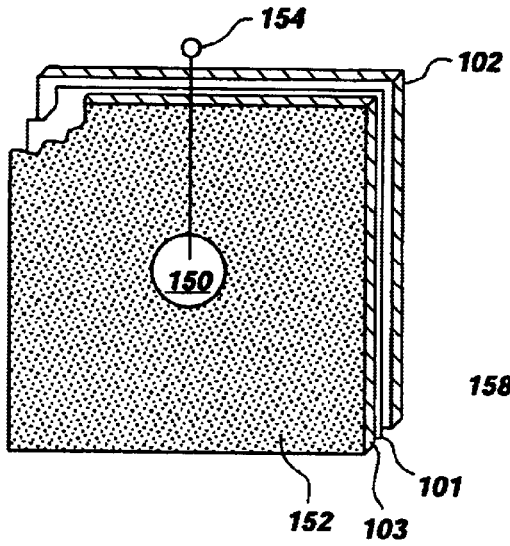
FIG. 1 shows a side view of an electrostatic speaker stator with a circular conductive contact region and a high resistivity region surrounding the conductive contact region.

As illustrated in FIG. 1, the present device provides a low resistivity contact patch 150 on at least one stationary electrode 103. Though it is not required, it is preferred, for best performance, that the contact patch in most embodiments be larger than the size of just an electrical contact point. It is suggested that the contact patch be at least the size of ⅓ wavelength of the highest frequency in the pass band of the loudspeaker. Surrounding this contact patch is one or more surfaces of the stationary electrodes or stator surfaces 152 which have resistivity based on a size of the stator, a size of the selected gap and a desired amount of dispersion. This resistivity should be a decreasing or constant high resistivity per square of area. This high resistivity can be greater than 10K Ohm per unit square (e.g., per square inch or centimeter). One signal contact 154 is provided to deliver a signal to the stator. Of course, a matching stator 102 would mate with the stator 103 shown in FIG. 1 with a diaphragm 101 sandwiched between them.

An important and surprising result of providing a resistivity area with a high starting value and falling resistivity surrounding the contact patch is that a sound source is created which grows and shrinks in a beneficial manner based on the area of the stator and the frequency being generated. That is to say low frequencies produced by the electrostatic speaker will drive more of the diaphragm and high frequencies will drive only a smaller portion of the diaphragm. In other words, the power used to reproduce the lower frequencies charges a greater area of the stator and the higher frequencies only charge a reduced area around the signal contact. The high resistivity also allows the use of a constant current amplifier, energizing the stator in driving the diaphragm, as opposed to a conventional constant voltage amplifiers. Constant equalization can also be used because the size of the area driven grows for lower frequencies. In fact, equalization can be substantially avoided if a constant resistivity is used.

Using a decreasing or constant resistivity on the stator also allows for a more even charge or energy distribution across the face of the stator. An even energy distribution avoids charge concentration in one spot on the stator and reduces the charge breakdown between the stator and the diaphragm. This means the stator can be driven to a higher voltage level before a charge break down or electrical arcing occurs. This type of break down has been a significant problem in prior art electrostatic loudspeakers.

Other significant electrical benefits of using a highly resistive area on a speaker also exist. A decreasing or constant stator resistance damps currents from resonances in the film as those resonances try to send currents back through the stator. Better transformer interaction also exists. The high resistivity on the stator counteracts inductive interactions which produce transformer power leakage. A further electrical advantage is that the high resistivity helps reduce the reactance in the speaker that is reflected to the amplifier.

When a high resistivity stator is used, less metalization is required on the stator. This means that when a plastic stator is used a substantially transparent stator will result because it will not be metalized to the degree of stators known in the prior art. It should be noted that transparent in this case does not necessarily mean that it is as transparent as glass but that it is a plastic which is substantially clear enough to transmit light. Greater visual transparency can be important because it allows the speakers to be used in applications where a visually transparent speaker is desirable.

Another advantage of this high resistivity area incorporated directly on or into the stator is that no external resistors are required. This simplifies the manufacturing of these speaker devices. Using a high resistivity coating which decreases or stays constant also provides a continuous resistivity as opposed to using discrete external resistors. A direct result of avoiding external resistors is that multiple contact points are not needed. Multiple contact points or separate electrodes increase the complexity of the speaker and the possibility of manufacturing defects.

The low resistivity contact patch can have less than 1 K Ohms of resistivity per square of area. Sizing of the contact patch is based on the highest frequency where the output is desired to be increased. For example, if the highest dispersion enhanced frequency of particular interest is 4000 Hz then the contact patch would be sized to correspond with somewhat less than the length of one wavelength (and ideal figure being on the order of ⅓ to 1 wavelength) at 4 kHz or less than 3.4 inches. Of course the size of the patch becomes smaller as the desired frequency to be enhanced is increased up to say 20 kHz or more. It has been discovered by the inventors that there is a practical limit as to the minimum size of the contact patch and the contact patch should be a finite size because at some point there is a diminishing amount of sound generated as compared to the amount of acoustic power needed to generate sound at a given frequency.

In conventional electrostatic speakers, as the frequency reproduced increases, the directivity or beaming effect of the sound increases. One way to reduce the directivity of the higher frequency sounds is to reduce the size of the speaker used to reproduce the high frequencies. When a small speaker is used to reproduce high frequencies then a greater dispersion of the sound is achieved. The present device has the significant advantage of allowing the amount of diaphragm driven by the stators to increase or decrease based on frequency. Thus, the directivity of the speaker is automatically adapted to the frequency being played. As the frequency increases, the size of the diaphragm driven by the stator decreases. This in turn increases the dispersion which is very desirable in an electrostatic speaker.

Another effect of the variable speaker source size is that it also controls the shape of the wave front curvature. One ideal shape of a sound wave front is a wave which is emitted from a speaker the shape of a sphere. The shrinking and increasing nature of this electrostatic speaker simulates a window of this ideal sound source. Because the dispersion can be kept constant at every frequency, the wave front can simulate the wave front that would be generated on one plane forward from an ideal spherical source. This approach controls the upper frequencies so that the appropriate dispersion can be provided at the most important midrange and high frequencies (e.g. voice).

FIG. 1 also has the advantage that equal amounts vertical and horizontal dispersion are possible, created by positioning the contact patch in the center of the stator. A constant or slightly falling resistance applied to the stator can provide both the desired directivity control and also an inherently flat frequency response curve. In a conventional dominantly capacitive stator structure, the amplitude response increases at a rate of 6 decibels (dBs) per octave as the frequency increases.

For constant directivity with frequency, the area 152, outside of the contact patch 150 would desirably have a high starting resistivity adjacent to the contact patch and have a decreasing resistivity with greater distance from the contact patch. As with many embodiments listed throughout the disclosure, this starting value resistivity can be on the order of 10,000, 100,000 or over 1,000,000 ohms per square and falling to 10,000 ohms per square or less as measured farther from the contact patch 150.

This embodiment can operate as a variable size point source. If, beyond the contact patch 150, one applies a constant or slightly decreasing resistivity per square unit, the 6 dB rising frequency response would be flattened out and the source size area would be proportional to 1/frequency. To maintain constant directivity over a given frequency band, the speaker would have a −6 dB per octave characteristic over that given frequency band. The achieve constant directivity over a full operating band, or pass band of the loudspeaker, the resistance would be falling substantially inversely proportional to distance from the contact patch.

The high resistivity can be optimized to achieve a reduction in a dominantly driven area substantially proportional to the inverse square of frequency over a range of at least one octave. Dominantly driven refers to the portion of the loudspeaker that is most active for a given frequency. Since the source size can effectively shrink with frequency to create a small source size to maintain dispersion, the dominantly driven area is the area that defines the apparent active source size. The remaining portion of the loudspeaker will have activity, but it will be much less than the dominantly driven area that is defining the active source size. This can be the case for all the various embodiments. The dominantly driven area can determine a selected amount of directivity or dispersion for a given frequency range of the loudspeaker by varying the contact patch size and also setting the level and rate of change of the high resistivity as it leads away from the contact patch.

It can be desirable to achieve substantially constant directivity operating over a majority of the pass band of the loudspeaker assembly. In a point source version, the resistance would be falling substantially inversely proportional to distance from the contact patch for some selected distance relating to the wavelengths of the frequency range of desired constant directivity.

Figure 2:
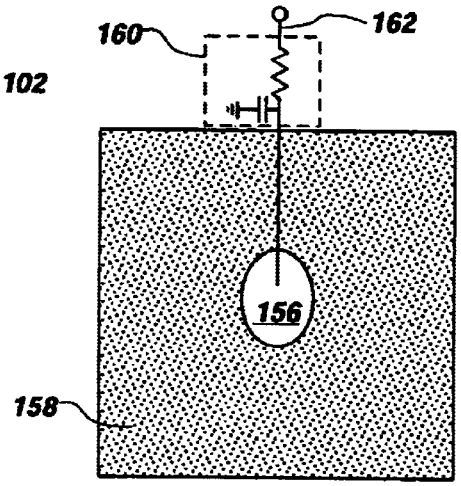
FIG. 2 shows a side view of an electrostatic speaker stator with an oval conductive contact region and a high resistivity region surrounding the conductive contact region.

FIG. 2 shows a side view of a stator in an electrostatic speaker which is similar to FIG. 1. The major difference in FIG. 2 is that the conductive contact patch 156 is oval shaped with the axis of the oval running vertically. This vertical orientation of the oval contact patch limits the vertical dispersion because of its greater vertical size, it sets a limit to and reduces the rate at which the apparent source size of the stator shrinks vertically as the frequency increases. The resistivity on the stator 158 can also be decreasing or constant with the preferred type being decreasing. A signal contact 162 is provided to deliver an audio signal or ultrasonic signal to the stator. A resistor and capacitor 160 can also be included in order to further shape the frequency response of the speaker. The oval contact patch can also be much more elongated than depicted in FIG. 2. The more elongated the oval is, the more the vertical dispersion will be restricted to lower frequencies. It can be important to control the vertical dispersion in some applications because it limits the amount of reflections off the ceiling and floor. Reflections from the ceiling tend to cause undesirable amplitude distortions creating sonic coloration at the listening position. Of course a certain amount of vertical dispersion is generally desirable so that the audio produced can be heard, at least to some degree, above and below the speaker. If limited vertical dispersion is provided then a tall speaker may be built to allow a listener to hear the sound more consistently, over a range of listening heights.

It can also be important to be able to have substantially constant dispersion over selected frequency ranges. One important frequency range is the middle of the human voice range. This critical range extends from less than 800 Hz up to 3 to 4 kHz. Thus, the resistivity over the stator output area that results in good dispersion over this frequency wavelength range will generally be a constant or decreasing resistivity to provide substantially constant dispersion for the voice range. A constant dispersion can be implemented over a range of 1 to 2 octaves and then it may be desirable to have the dispersion decrease by further controlling resistivity and sizing and shaping of the low impedance contact patch.

Figure 3:
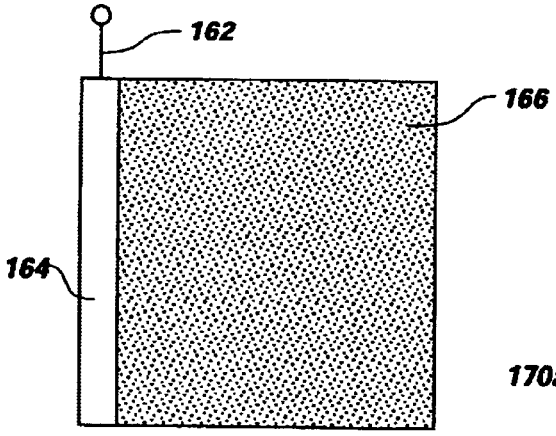
FIG. 3 shows a side view of an electrostatic stator with a rectangular conductive contact region which extends the length of the stator along one edge.

FIG. 3 depicts a side view of an electrostatic stator with an elongated rectangular contact patch 164. This configuration provides a contact patch, which is to the left (or right) of the resistive area 166. Of course, the resistive patch could be on any edge or portion of the edge of the stator. A signal contact 162 delivers a signal to the stator(s). The enhancement of the sound dispersion of this resistive arrangement is in the horizontal. This resistivity can be a decreasing or constant high resistivity per square of area in an orientation away from the contact patch. This configuration has the advantage that it is simple to manufacture because the contact patch is situated on the edge of the square or rectangular stator. Since this configuration increases dispersion in the horizontal direction, it may be desirable to make a taller, line source version of the structure that has greater height than width.

Figure 4:
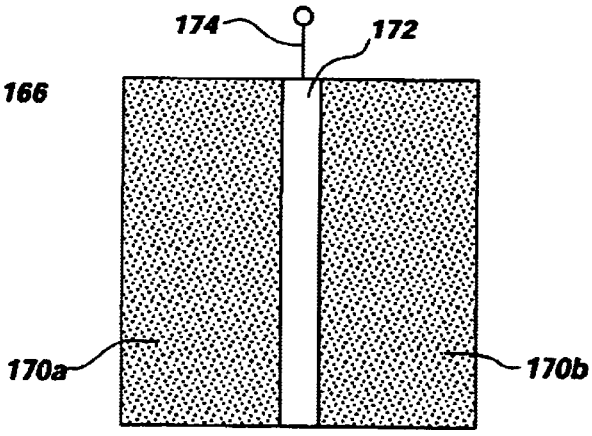
FIG. 4 illustrates an electrostatic stator with a rectangular conductive contact region which extends across the center of the stator.

FIG. 4 illustrates a resistive electrostatic stator with left resistive area 170*a* and right resistive area 170*b* and a signal contact 174. A rectangular conductive contact patch 172 horizontally centered in the stator provides a sound source with variable horizontal dispersion. Although this configuration will tend to have high vertical directivity, the horizontally dispersive nature of this stator configuration can provide a flat frequency response with an applied decreasing or constant resistivity. As with the device in FIG. 3, since this configuration increases dispersion in the horizontal direction, it may be desirable to make a taller, line source version of the structure that has greater height than width.

When operating as a line source with dispersion enhancement in just one plane, such as in the horizontal plane, a constant or slightly falling resistivity will result in a system with +3 dB per octave amplitude response and the apparent acoustic width size will be proportional to 1/the square root of frequency or $$\frac{1}{\sqrt{f}}.$$

For substantially constant directivity in one plane over an operating band, the amplitude will have a flat response and the resistance will be inversely proportional to distance from the contact patch.

A similar alternative embodiment rotates the stator illustrated in FIG. 4 ninety degrees to form a horizontal contact patch that bisects the speaker, which can enhance vertical dispersion.

One advantage to using a single, continuous stator, with decreasing or constant resistivity, is that it overcomes problems produced by multiple adjacent sections. Besides the greater complexity, electrostatic speakers which use external resistors and multiple stator sections have additional problems created by the capacitance between the section gaps. Additional unwanted capacitance creates additional, non-working impedance losses which wastes useful energy. Using only one section also avoids the loss of drive in the gaps between sections. When only one stator section is required then this can eliminate the need for separate tweeter and mid-range sections. Elimination of the tweeters and other sections also can eliminate the need for a corresponding crossover network.

Figure 5:
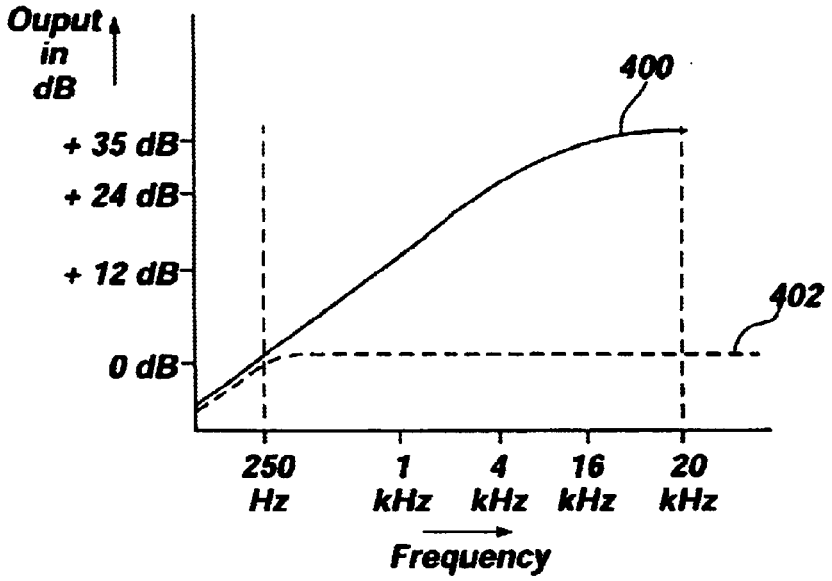
FIG. 5 is a graph of the frequency response of a conventional electrostatic speaker which is has a high conductivity and capacitance.

FIG. 5 includes a graph 400 of the frequency response of a conventional electrostatic speaker which has a high conductivity stator and capacitance. As can be seen, the frequency response in conventional electrostatic speakers is such that the decibel output decreases at 6 dB per descending octave down to the fundamental resonant frequency of the diaphragm. It would be desirable to have a frequency response which is flatter and more manageable in the lower frequencies. Of course, equalization can be used to boost the lower frequencies as compared to the higher frequencies but it can be more desirable to have an electrostatic speaker with a more inherent even frequency response. An embodiment of the invention such as in FIGS. 3 and 4 can maintain substantially constant horizontal dispersion and exhibit inherently smooth frequency response as shown by curve 402.

Figure 6:
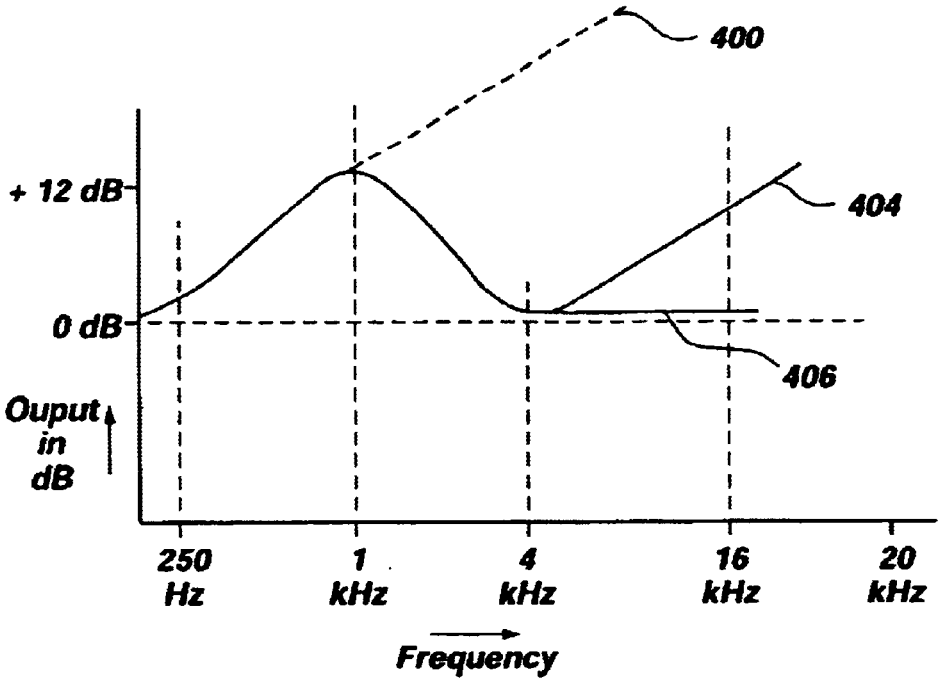
FIG. 6 is a graph of the frequency response of a device with a highly resistive coating to control the directivity and output of the speaker.

FIG. 6 is a graph of the frequency response of one device embodiment with a highly resistive coating to control the directivity and output of the speaker. 0 db is the reference level for the system. In this example, it can be seen how the rising response energy 400 of a conventional electrostatic loudspeaker can be converted to a falling response with ascending frequency which through the inventive means of a high starting value and falling resistivity can convert this excess on axis energy to more broadly dispersed energy with frequency. The division between 250 Hz and 1 kHz represents the low sounds that will be derived from the majority of the area of the speaker. The division between 1 kHz and 4 kHz represents acoustic output from the speaker generated from the reduced radiating area created by the use of high resistivity that is decreasing with distance from the edge of the low resistance contact patch 150 (in FIG. 1) of the device, providing substantially constant acoustic dispersion over this frequency range. The final division depicted from 4 kHz on up represents the contact patch area where the frequency response would be more constant because of the more constant size and either continuous and/or low resistivity of that area. Active or passive electronic equalization could be incorporated to smooth the response from 250 Hz to 1 kHz and optionally the same could be done for the region from 4 kHz to the highest operating frequency. The rise of curve 404 compared to the flattened curve of 406 will differ for frequencies above 4 kHz depending on the nature of the size, shape, and resistivity of the contact patch area 150 in FIG. 1. The tendency for the curve shape of 404 would be due to a larger, (approximately one wavelength at 4 kHz) highly conductive construction of the contact patch whereas to achieve curve 406 above 4 kHz may require some more constant resistivity across the contact patch to the point of actual electrical input contact. This curve would generally be representative of some constructions of the embodiments shown in FIGS. 1, 2 7, and 8.

Figure 7:
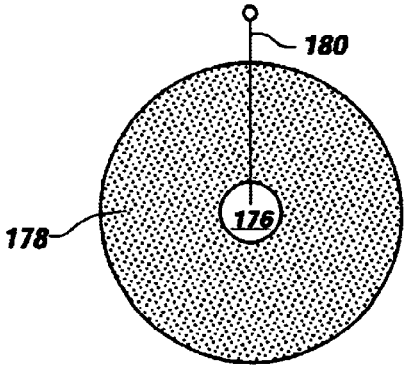
FIG. 7 illustrates a round electrostatic stator with one conductive contact region and a concentric resistive region surrounding the conductive contact region.

FIG. 7 depicts a round electrostatic stator with one circular conductive contact region 176 and a concentric resistive region 178 surrounding the conductive contact region. This arrangement also includes a resistivity that can be a decreasing or constant high resistivity per square of area in an orientation away from the contact patch and provides a more symmetrical dispersion pattern through all frequency ranges. In addition, the dispersion patterns are constant in all angles from the center contact, where even a substantially constant directivity at all angles from horizontal thru vertical in pattern can be evenly produced. Only one signal contact 180 is provided. Using only one signal contact is advantageous as compared to the prior art which needed many contacts to attach to separate diaphragm areas. Additionally, the prior art contacts each required external resistors which are costly to manufacture and multiple resistors are needed for the speaker. In the present device, no external resistors are required and better dispersion patterns can be created because the size of the speaker output area is directly correlated to the frequency reproduced.

Figure 8:
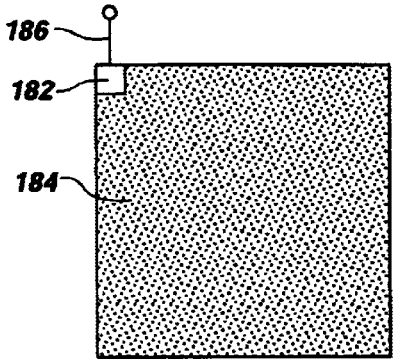
FIG. 8 illustrates a square stator with a conductive contact region at one corner and a high resistivity over the rest of the stator.

FIG. 8 illustrates a square stator with a square conductive contact patch 182 at one corner with a high resistivity 184 over the rest of the stator, and a signal contact to deliver an audio or ultrasonic signal 184. FIG. 8 is a simpler construction that can be more cost effective to manufacture. The dispersion pattern is formed from a speaker that has a source size that enlarges from the corner as the frequency decreases and the area of the speaker being driven shrinks as the frequency increases. When deeper bass sounds are played they will use more of the speaker and therefore more effectively fill the room with acoustic output. In contrast, higher sounds such as voices and upper range music will be dispersed from the conductive contact point.

Figure 9:
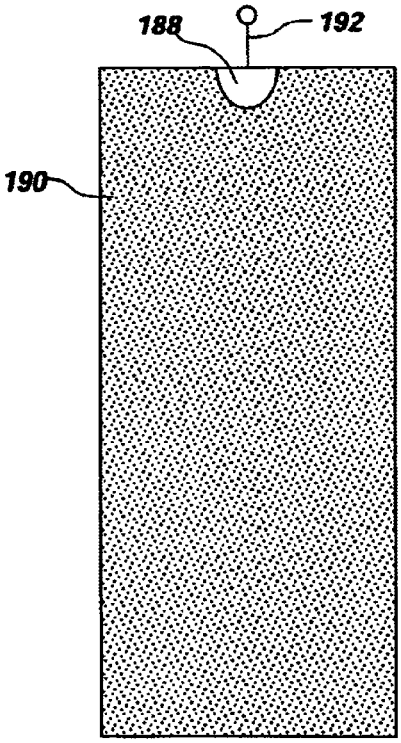
FIG. 9 illustrates a rectangular stator with a conductive region on one edge of the stator and a high resistivity over the remaining portion of the stator.

FIG. 9 illustrates a rectangular stator with a conductive contact patch 188 on one edge of the stator including a high resistivity 190 over the remaining portion of the stator, and a signal contact 192. This resistivity can be a decreasing or constant high resistivity per square of area in an orientation away from the contact patch. FIG. 9 is a hybrid between FIG. 1 and FIG. 4. The elongated rectangular shape provides a somewhat increased horizontal dispersion compared to the vertical dispersion. Since the contact patch 188 is situated at the top of the rectangle, there is also a somewhat more vertically placed sound field in contrast to the device of FIG. 4, of which the highest frequencies are projected from a lower height.

Figure 10:
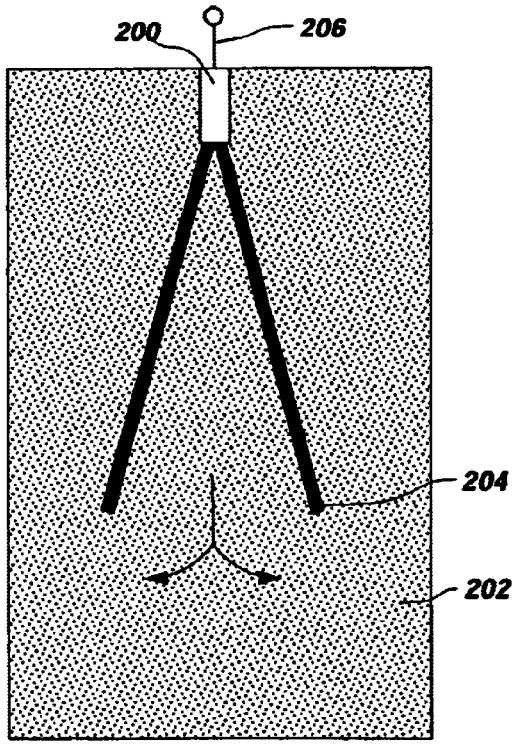
FIG. 10 illustrates a rectangular stator with a V-shaped insulator formed in the resistive stator with a conductive contact region at the bottom of the V-shaped insulator.

FIG. 10 illustrates a rectangular stator with a V-shaped insulator 204 formed in the resistive stator with a conductive contact patch 200 at the apex of the V-shaped insulator. The remaining portions of the stator are covered with high resistivity material 202 and a signal contact 206. Again, this resistivity can be a decreasing or constant high resistivity per square of area in an orientation away from the contact patch. The contact patch is provided to reproduce the highest frequency of interest. Then as the frequency decreases the signal power will begin at the bottom of the V-shaped insulator and follow the arrows in FIG. 10 to use a greater area of the stator. This specialized configuration provides a stator output which drives the center of the diaphragm first and then works its way to the outer edges of the diaphragm as the frequency decreases. Of course, the triangular area within the V-shaped insulator and the remaining areas are covered with a high resistivity coating which is preferably decreasing in resistivity with increase in distance from the contact patch 200. A constant resistivity could also be used.

Figure 11:
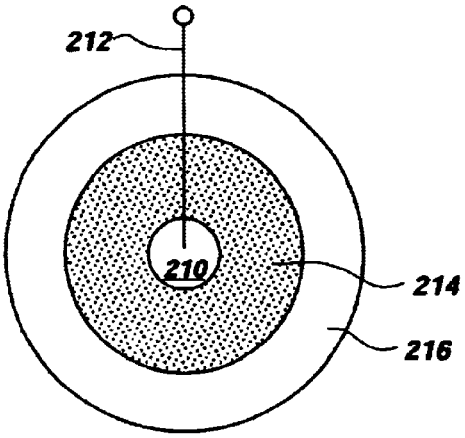
FIG. 11 illustrates a round electrostatic stator with one conductive contact region, a concentric resistive region and an outer concentric conductive region.

FIG. 11 illustrates a round electrostatic stator with one conductive contact patch 210 and a signal contact 212 connected to the contact patch. A concentric highly resistive region 214 is formed on the stator and is surrounded by an outer concentric conductive region 216. The resistivity in the highly resistive region is preferably decreasing or constant and it is surrounded by an area at a selected distance from the contact patch which is essentially conductive (e.g. preferably ≦500–1000 Ohms). Alternately, the essentially conductive region could also be a constant resistivity which is significantly lower than the highly resistive region.

Figure 12:
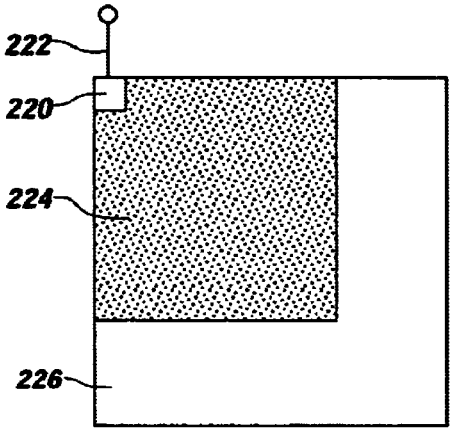
FIG. 12 illustrates a square electrostatic stator with a conductive contact region at one corner of the stator, and an adjacent square or rectangular resistive region bordered by a generally L-shaped low resistance region.

FIG. 12 illustrates a square electrostatic stator with a conductive contact patch 220 at one corner of the stator and a signal contact 222 to deliver the audio or ultrasonic signal to the stator. A highly resistive area 224 is applied to one section of the stator near the contact patch and this section is bordered by an area at a selected distance from the contact patch 226 with preferably, substantially no resistance or a low constant resistance. The highly resistive area can be a decreasing or constant high resistivity per square of area in an orientation away from the contact patch. This allows the size of the diaphragm being driven to be a specific selected size at high frequency equal to the size of the contact patch. Then as the frequency decreases more of the stator is used and at a certain frequency dispersion is less important and thus a portion of the stator has little resistance.

Figure 13:
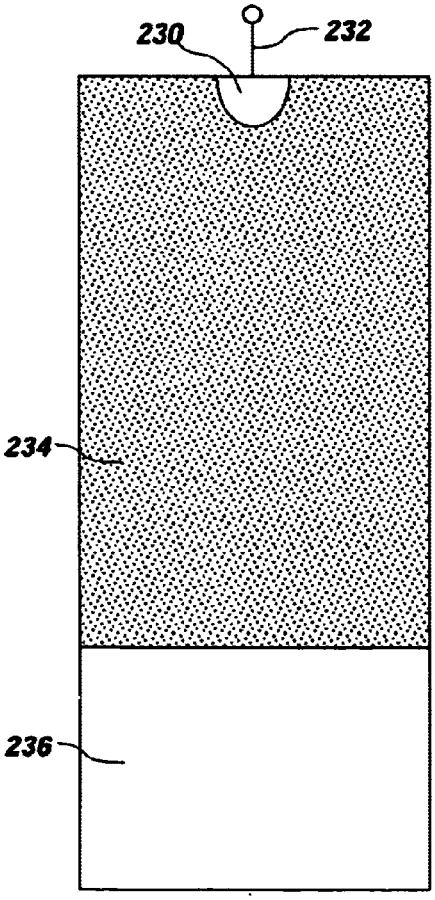
FIG. 13 illustrates a rectangular electrostatic stator with a conductive contact region on one edge of the stator, and an adjacent rectangular resistive region bordered by a low resistance region.

FIG. 13 shows a rectangular electrostatic stator with a conductive contact patch 230 on one edge of the stator and a signal contact 232 connected to the contact patch. A portion of the rectangular stator adjacent the contact patch is covered with a highly resistive material 234. At a selected distance from the contact patch a second portion of the stator 236 has a low resistivity or substantially little resistance. The second portion of the stator with low resistivity allows the stator to expand to its full area when driving at low frequencies. The high resistivity area determines what threshold is used to control the directivity of the higher frequencies. The frequencies whose directivity will be affected by the high resistivity area are determined by the size of the high resistivity area surrounding the contact patch and the rate at which the resistivity decreases outwardly from the contact patch 230.

Figure 14:
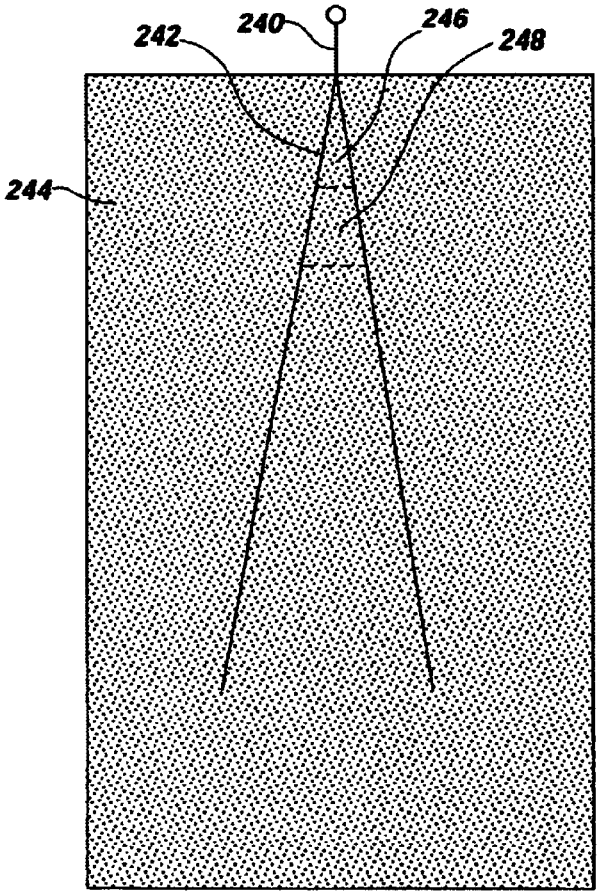
FIG. 14 illustrates a rectangular stator with a V-shaped insulator formed in the resistive stator with a signal contact point at the bottom of the V-shape.

FIG. 14 is a rectangular stator with a V-shaped insulator 242 formed in the resistive stator with a signal contact 240 connected to the apex of the V-shape. This figure is similar to FIG. 10 with the exception of the low resistivity contact patch. The signal provided will first drive the narrow portions of the V-shape and then as the frequency decreases it will expand to fill the V and finally the rest of the stator. A high resistivity coating 244 is applied to the stator to control the directivity of the speaker as described above. The coating can be a decreasing or constant resistivity. Although no contact patch is shown there could be a contact patch as shown by the area surrounded by the dotted line 246. A larger contact patch could be created as indicated by 248. It is also possible to create two different contact patches with differing falling resistances as required by the frequency output and desired directivity.

Any of the electrostatic loudspeaker assemblies disclosed throughout this description can be inverted or built in an inside-out fashion, wherein the two AC electrodes are two vibratable diaphragms which are driven by receiving a sound signal and gapped away from and interacting with the DC electrode as a stationary stator centered between the two diaphragms.

Figure 15:
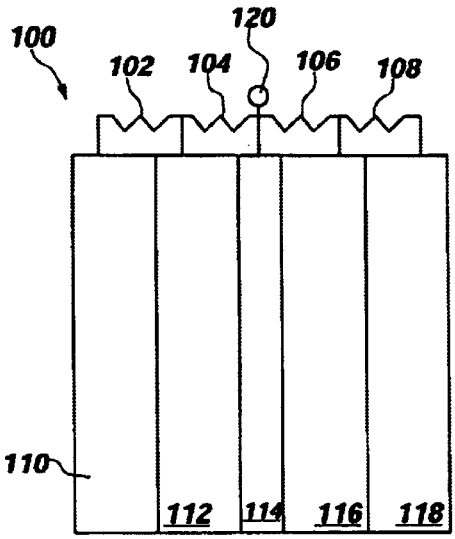
FIG. 15 (PRIOR ART)
FIG. 15 is a side view of a prior art electrostatic speaker stator including a plurality of external resistors connected to separate rectangular sections of a stator.
Figure 16:
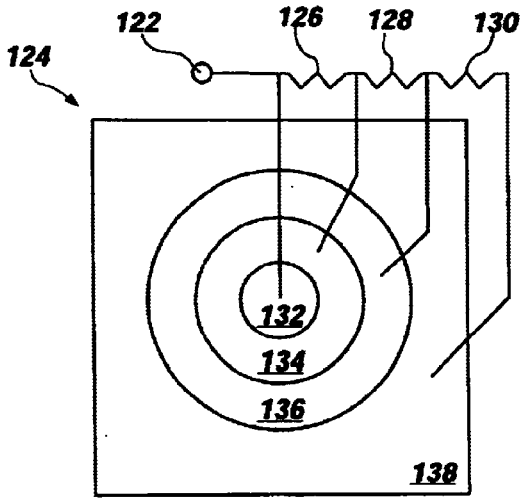
FIG. 16 (PRIOR ART)
FIG. 16 is a side view of a prior art electrostatic speaker stator including a plurality of external resistors connected to separate concentric sections.

FIG. 15 illustrates a side view of a prior art electrostatic speaker stator 100 including a plurality of external resistors 102–108 connected to separate rectangular sections of a stator 110–118. A signal to drive the stator is applied through the electrical connection 120. FIG. 16 illustrates a side view of a prior art electrostatic speaker stator including a plurality of external resistors connected to separate concentric sections. A signal voltage 122 is delivered to the stator 124 via three resistors 126, 128, 130 with separate electrical contacts for each stator segment 132–138.

The prior art devices of FIGS. 15 and 16 have greater complexity than the present invention, due to the individual segment construction and multiple contact points that must be integrated. Greater complexity is also produced by greater stray capacitance generated between segments causing additional losses and reduced efficiency, wasted clamped off areas between the segments, and a lack of smoothness to the dispersion enhancement due to the segments having fixed external resistance values that jump from segment to segment, instead of the smooth seamless transitions of the present invention.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. An electrostatic loudspeaker device, comprising:

(a) one DC electrode;

(b) two AC electrodes, adjacent to and on opposite sides of the DC electrode, spaced a selected gap from the DC electrode;

(c) a low resistivity contact patch on each AC electrode, configured to receive an electronic signal; and (d) at least one surface of the AC electrodes, adjacent the low resistivity contact patch, having a substantially decreasing resistivity in an electrical path oriented away from the low resistivity contact patch, the substantially decreasing resistivity of the surface of the AC electrode immediately adjacent the contact patch having a resistivity greater than the contact patch resistivity.

2. The electrostatic loudspeaker device as in claim 1, wherein the two AC electrodes are two stationary stators and the DC electrode is a partially conductive diaphragm which is driven by a sound signal applied to the AC electrodes.

3. The electrostatic loudspeaker device as in claim 2, wherein the low resistivity contact patch on each stationary stator is substantially at a center location of the stationary stators and does not extend to an edge of the stators.

4. The electrostatic loudspeaker device as in claim 2, wherein the low resistivity contact patch on each AC electrode is located along a single edge of the stationary stators.

5. The electrostatic loudspeaker device as in claim 1, wherein the low resistivity contact patch on each AC electrode is greater than a size of an associate electrical contact.

6. The electrostatic loudspeaker device as in claim 1, wherein the low resistivity contact patch on each AC electrode is round in shape.

7. The electrostatic loudspeaker device as in claim 1, wherein the low resistivity contact patch on each AC electrode is oval in shape.

8. The electrostatic loudspeaker device as in claim 1, wherein the low resistivity contact patch on each AC electrode is rectangular in shape.

9. An electrostatic loudspeaker device, comprising:

(a) a partially conductive diaphragm;

(b) two stators, having stator edges and being substantially parallel to the partially conductive diaphragm in a sandwich configuration with respect thereto and being spaced at a selected gap from the diaphragm;

(c) a low resistivity contact patch on each stator, configured to receive an electronic audio signal, wherein the stators drive the partially conductive diaphragm with the audio signal; and (d) at least one surface area of the stators, having a resistivity which varies in decreasing value across the stator in a path extending away from the low resistivity contact patch toward the stator edge.

10. An electrostatic loudspeaker device as in claim 9, wherein the varying resistivity is a constant resistivity near the low resistivity contact patch and a substantially decreasing resistivity as a distance from the low resistivity contact patch and constant resistivity increases.

11. An electrostatic loudspeaker device as in claim 9, wherein the varying resistivity is a constant resistivity near the low resistivity patch and substantially less resistivity exists a pre-selected distance from the low resistivity contact patch.

12. An electrostatic loudspeaker device, comprising:

(a) a partially conductive diaphragm;

(b) two stators, having stator edges and being substantially parallel to the partially conductive diaphragm in a sandwich configuration with respect thereto and being spaced at a selected gap from the diaphragm;

(c) a low resistivity contact patch on each stator, configured to receive an electronic audio signal, wherein the low resistivity contact patch on each stator is configured to be at least ⅓ wavelength of a highest frequency in a pass band of the loudspeaker and the stators drive the partially conductive diaphragm with the audio signal; and (d) at least one surface area of the stators, having a resistivity which varies across the stator in a path extending away from the low resistivity contact patch toward the stator edge.

13. An electrostatic loudspeaker device as in claim 12, wherein the varying resistivity is a substantially decreasing resistivity as distance from the low resistivity patch increases.

14. An electrostatic loudspeaker device as in claim 12, wherein the varying resistivity is a constant resistivity near the low resistivity patch and a decreasing resistivity as the distance from the low resistivity patch increases.

15. An electrostatic loudspeaker device as in claim 12, wherein the varying resistivity commencing at the contact patch is a decreasing resistivity as the distance from the low resistivity patch increases.

16. An electrostatic loudspeaker device as in claim 12, wherein the stators are substantially transparent.

* * * * *